United States Patent [19]

Besson

[11] 4,188,774

[45] Feb. 19, 1980

[54] ELECTRO-MECHANICAL CALENDAR TIMEPIECE

[75] Inventor: Rene Besson, Neuchatel, Switzerland

[73] Assignee: Ebauches S.A., Neuchatel, Switzerland

[21] Appl. No.: 838,049

[22] Filed: Sep. 30, 1977

[30] Foreign Application Priority Data

Oct. 4, 1976 [CH] Switzerland ..... 12509/76

[51] Int. Cl.[2] ..... G04B 19/24

[52] U.S. Cl. ..... 58/4 A; 58/58

[58] Field of Search ..... 58/4 R, 4 A, 23 R, 58, 58/855, 23 D

[56] References Cited

U.S. PATENT DOCUMENTS

| | | | |
|---|---|---|---|
| 3,477,222 | 11/1969 | Leung et al. | 58/4 A |
| 3,681,913 | 8/1972 | Solari | 58/4 R |
| 3,733,803 | 5/1973 | Hiraga et al. | 58/23 R |
| 3,827,234 | 8/1974 | Imanishi | 58/58 |
| 3,834,151 | 9/1974 | Bodet | 58/4 A |
| 3,992,868 | 11/1976 | Tamaru et al. | 58/5 |
| 4,026,100 | 5/1977 | Kume et al. | 58/4 R |
| 4,059,953 | 11/1977 | Morrison et al. | 58/4 R |
| 4,092,820 | 6/1978 | Kume et al. | 58/23 R |

*Primary Examiner*—Vit W. Miska

*Attorney, Agent, or Firm*—Silverman, Cass & Singer, Ltd.

[57] ABSTRACT

A device for automatically correcting the date indicator of an electro-mechanical timepiece to the first date of the next month at the end of each month. A pulse driven motor advances the date indicator one date in response to a plurality of pulsed drive signals with the motor advancing one step for each drive signal pulse, and at a speed corresponding to the drive signal frequency. A fixed number of drive signal pulses are applied to the motor each month to advance the date indicator through the dates of each month to the first date of the next month. A predetermined number of the drive signal pulses, corresponding to the number of dates of each month, are applied to the motor at a normal advance frequency normally to advance the date indicator. The remaining number of the drive signal pulses, for each month having less than 31 days are applied to the motor at a rapid advance frequency which is greater than the normal advance frequency, rapidly to advance the date indicator and indicate the first date of the next month.

16 Claims, 2 Drawing Figures

ELECTRO-MECHANICAL CALENDAR TIMEPIECE

Figure 1:
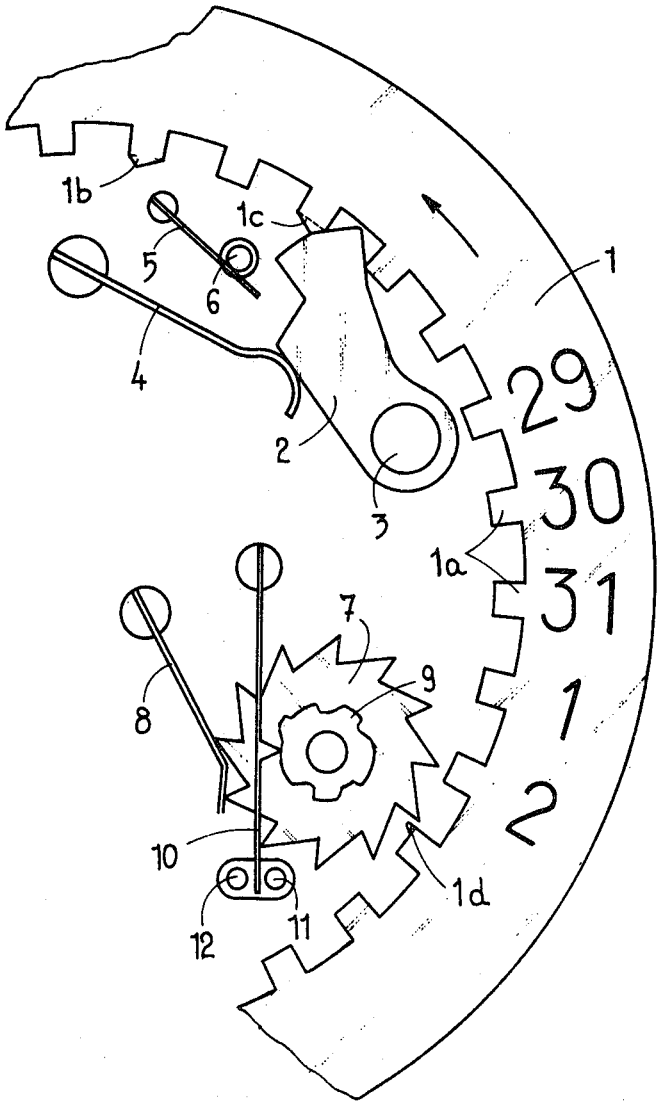

The present invention relates to an electromechanical calendar timepiece including a date indicator, and a control circuit for a motor which allows the motor to operate at two different speeds.

This timepiece includes means for furnishing to the motor an equal number of control pulses each month. The frequency of these pulses are highest at the end of the months which have less than 31 days, to automatically correct the date indicator at the end of months having less than 31 days.

The drawing shows, by way of example, one embodiment of the object of the invention.

Figure 2:
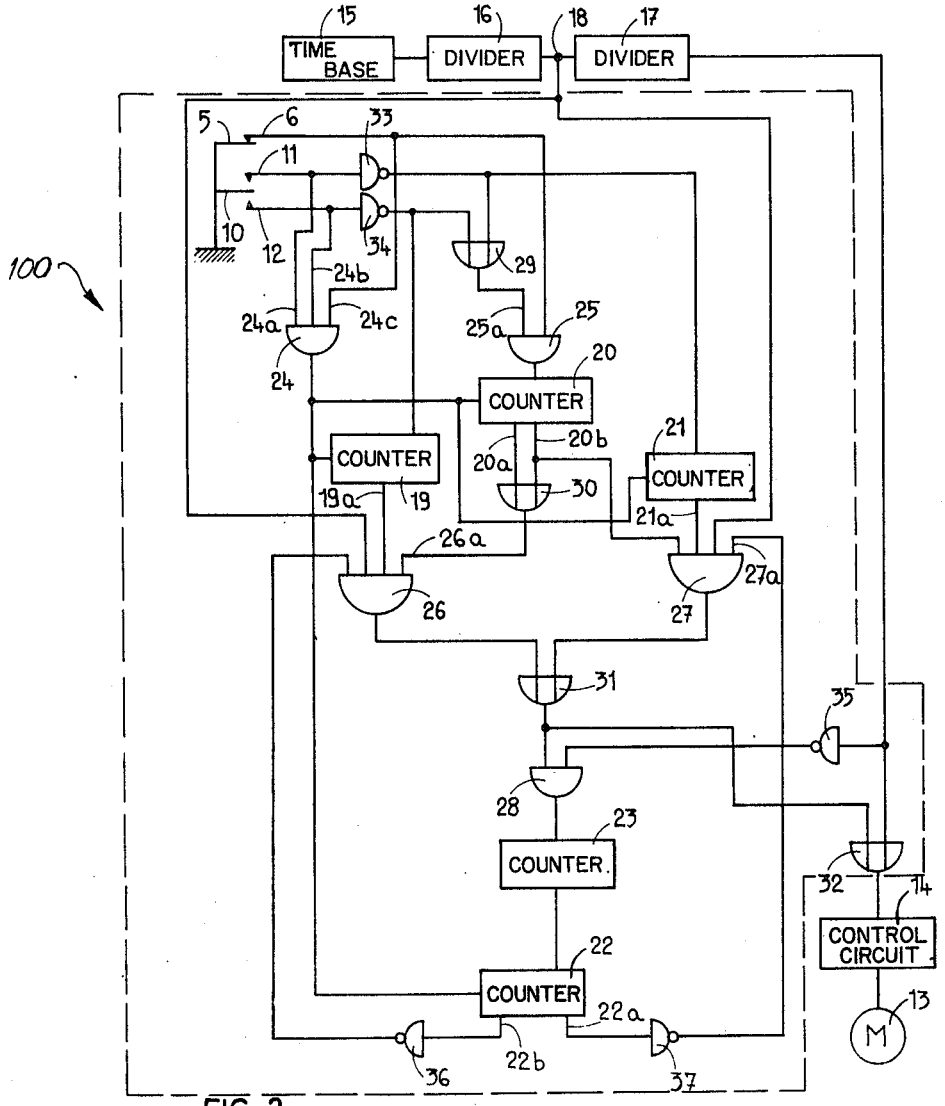

FIG. 1 is a plan view of a portion of an electromechanical calendar watch, and FIG. 2 shows the electronic diagram of this watch.

The watch as represented includes a date indicator 1, having the shape of a crown, presenting a plurality of teeth 1*a* by which it is driven, once per twenty-four hours, through the gearing of the movement, and by driving means not shown.

A jumper 2 articulated at 3 on the frame of the movement is biased against teeth 1*a* by a return spring 4 to ensure the stability of the several positions of the date indicator 1. Two teeth of indicator 1 respectively are provided with protrusions 1*b* and 1*c*. Each time these teeth cooperate with the jumper 2 corresponds respectively to the change of the indicator 1 from the 28th to the 29th day of the month and from the 30th to the 31st day of the month. The jumper is moved by these protrusions 1*b* and 1*c* further than it is moved by the other teeth 1*a*, so that it moves a resilient blade 5, which forms a normally closed contact with contact stud 6, opening the contact between the blade and the stud.

The watch also includes a ratchet wheel 7, having twelve teeth, detented by the action of a jumping spring 8. The wheel 7 cooperates, once per revolution of the date indicator 1, that is to say once per month, which a finger 1*d* presented by one of the teeth 1*a* of the indicator 1. Consequently, this ratchet wheel 7 makes one revolution per year. Rachet wheel 7 is fixed to a cam 9 cooperating with a resilient blade 10 which is able to occupy three positions, i.e. an intermediary position, represented in FIG. 1, a second position in which it is in electrical contact with a pin 11 and a third position in which it is in electrical contact, with a pin 12. The arrangement of the cam 9 is such that, when the month has a duration of 31 days, the blade 10 is not in contact with either of the two pins, as shown in FIG. 1, while, when the month has a duration of 30 days, the blade is in contact with the pin 11 and during the month of February, it is in contact with the pin 12.

The circuit as represented in FIG. 2 includes a time base 15, constituted for instance by a quartz crystal resonator, controlling a first divider 16 the output pulses of which have a frequency of 64 Hz, and a divider second 17 the output pulses of which have a frequency of 1/30 Hz, and a control circuit 14, coupled to dividers 16 and 17, controlling a motor 13 which drives the several indicating members of the watch.

The circuit as represented further includes a date correction circuit 100 connected, at 18, between the dividers 16 and 17. This date correction circuit includes the electric contacts 5–6, 10–11 and 10–12 hereinbefore described. It includes moreover five counters 19, 20, 21, 22 and 23, five AND gates 24, 25, 26, 27 and 28, four OR gates 29, 30, 31 and 32, and five inverters 33, 34, 35, 36 and 37.

The counter 19, also called the February, counter can be in a state 0 or 1. When this counter is in the 1 state, its output 19*a* is at the logic state 1. The state of this counter passes from 0 to 1 during the passing from January 31 to February 1, by the closing of the contact 10–12. The counter 20 can be in a state 0, 1 or 2. This counter is controlled by the opening of the contact 5–6 when one of the contacts 10–11 or 10–12 is closed. When this counter is at 1, its output 20*a* is at the logic state 1. When it is in the 2 state, its output 20*b* is at the logic state 1.

The counter 21, also called the 30 days counter, can be in a state 0 or 1. When this counter is in the 1 state, its output 21*a* is at the logic state 1. The state of this counter passes from 0 to 1 during the passing from the 31st of one month to the first of a month having 30 days, by the closing of the contact 10–11.

The counter 22 can be in a state 0, 1, 2 or 3. When this counter is in the 1 state, its output 22*a* is at the logic state 1; as is the output 22*b* when this counter is in the 3 state. This counter is controlled by the pulses coming from the counter 23, each time counter 23 passes from its maximum capacity or count to 0.

The counter 23 has a capacity of counting up to 2880, that is to say it has a state which can pass from 0 to 2879. This capacity corresponds to the number of pulses which is necessary for the hour indicator to make two revolutions.

This circuit operates as follows:

If the current month has 31 days, the switches 10–11 and 10–12 are open, their outputs being then at the logic state 1. This way, the inputs 24*a* and 24*b* of the AND gate 24 are also at the logic state 1. During the whole beginning of the month, the switch 5–6 remains closed. Its output is then at the logic state 0, so that the input 24*c* of the AND gate 24 is also at the logic state 0; this gate is thus locked. When the date indicator 1 passes from the 28th to the 29th of the month, the switch 5–6 becomes open, as a result of the protrusion 1*b* cooperating with the blade 5, so that its output passes to the logic state 1, which produces the reset to 0 of the counters 19, 20, 21 and 22 the purpose of which will be indicated later. The switches 10–11 and 10–12 being open, the two inputs of the OR gate 29 are at the logic state 0 as is the output of this gate. The input 25*a* of the AND gate 25 is consequently at the logic state 0, which prevents the logic signal 1 produced by the opening of the switch 5;14 6 to operate the counter 20. When the date indicator 1 passes from the 30th to the 31st of the month, the contact 5–6 is open again, under the action of the protrusion 1*c* of the indicator 1 acting on the blade 5, so that the output of the AND gate 24 delivers again a logic signal 1, but without effect, since all the counters are at the state 0.

If this month of 31 days is followed by a month having 30 days, the switch 10–11 is closed, under the action of the cam 9, which is itself controlled by the finger 1*d* of the indicator 1, when passing from the 31st to the 1st day of the month. The output of switch 10–11 is then at the logic state 0, as is the input 24*a* of the AND gate 24. This gate is consequently locked. When the output of the switch 10–11 passes to the logic state 0, the output of the inverter 33 passes to the logic state 1. This change brings the content of the 30 days counter 21, to increase by 1, which makes its output 21*a* pass from the logic state 0 to the logic state 1. The input 25*a* of the AND gate 25 is also at the logic state 1. When the date indicator 1 passes from the 28th to the 29th of the month, the switch 5–6 becomes open, which brings its output to the logic state 1. The output of the AND gate 25 consequently passes to the logic state 1, which increments the counter 20, 1 unit, its state passing from 0 to 1. Its output 20*a* passes from the logic state 0 to the logic state 1. The output of the OR gate 30 passes consequently also to the logic state 1, as well as the input 26*a* of the AND gate 26. However, as the February counter 19 is at 0, its output 19*a*, corresponding to the state 0 of this counter, is at the logic state 0.

Consequently, the AND gate 26 remains locked. The AND gate 27 is also closed, since the output 20*b* of the counter 20 is at the logic state 0. When the date indicator 1 passes from the 30 th to the 31st of the month, the switch 5–6 is open again, advancing the state of the counter 20 from 1 to 2. Its output 20*b* passes to the logic state 1. As the counter 21 is at 1, its output 21*a* is at the logic state 1. Moreover, as the counter 22 is at 0, its output 22*a* is at the logic state 0, so that the output of the inverter 37 is at the logic state 1. This way, the AND gate 27 is open, permitting the passage of the pulses coming from the divider 16. These pulses produce the running of the motor 13, which controls the indicating members of the watch, at a frequency of 64 Hz, through two OR gates 31 and 32 and through the control circuit 14 for the motor. These pulses increment also the counter 23 through the AND gate 28. As a matter of fact, this AND gate 28 is closed so long as the output of the divider 17 is at the logic state 0, that is to say so long as the divider 17 does not send pulses causing the normal advance of the time indicators. When this divider 17 sends a normal advance pulse, the motor 13 is driven one step, but the counter 23 is not incremented. Hence, the exact hour indication is not jeopardized in spite of the fact that the correction of the date takes a time which is longer than the time separating two normal driving pulses of the motor.

When the counter 23 has counted 2880 pulses, which corresponds to two complete revolutions of the hour indicating member, it returns again to state 0, bringing at the same time its output to the logic state 1, which causes the counter 22 to pass from 0 to 1, its output 22*a* passing from the logic state 0 to the logic state 1. This way, and due to the inverter 37, the input 27*a* of the AND gate 27 passes to the logic state 0. This gate is consequently locked. The motor resumes its normal rythm, that is to say advancing one step each thirty seconds. Consequently, the date indicator 1 has moved a supplementary step and is thus indicating the 1st of the month, i.e. the 1st day of the month of 31 days. During the passage of the 28th to the 29th of this month, the counters 19, 20 and 22 are reset to 0, the circuit being ready to effect the correction of a month of less than 31 days.

During the month of February, the switch 10–11 is open and the switch 10–12 is closed. When the switch 10–12 becomes closed, in the beginning of the month, the change of logic state makes the counter 19 pass from the state 0 to the state 1. Its output 19*a* passes to the logic state 1. When the date indicator passes from the 28th to the 29th, the counter 20 passes from the state 0 to the state 1, its output 20*a* passing from the logic state 0 to the logic state 1. This way, the input 26*a* of the AND gate 26 is at the logic state 1. As the counter 22 is at 0, its output 22*b* is also at the logic state 0, so that the output of the inverter 36 is at the logic state 1. The AND gate 26 is consequently open, permitting the passage of the pulses coming from the divider 16 and operating the circuit with the same process as has been hereinbefore described to advance the indicator 1. However, this time, the counter 23 must count three times up to 2880 before the output 22*b* of the counter 22 passes from the logic state 0 to the logic state 1, thus locking the AND gate 26. This way, the hour indicator has made six revolutions, the date indicator displaying then the 1st of March, which is the day following the 28th of February. It is also to be noted that, when the date indicator 1 passes from the 30th to the 31st, during the correction of the date for February, the opening of the contact 5–6 has no effect on the development of the process, this signal making only the output 20*a* of the counter 20 to pass from the logic state 0 to the logic state 1 and the output 20*b* of this counter to pass from the logic state 0 to the logic state 1. However, since these outputs are connected in parallel, owing to the OR gate 30, the input 26*a* of the AND gate 26 remains at the logic state 1.

What I claim is:

1. Means for automatically correcting the date indicator of an electro-mechanical timepiece each month, said means comprising:

date indicator means contained in said timepiece for displaying the date of the month, said date indicator means being advanceable day by day during each month from a first position at the first day of a month to said first position at the first day of the next month;

a pulse driven motor having output means coupled to said date indicator means for advancing the date indicator means, said output means being advanced one step by said motor in response to each pulse of a pulsed drive signal applied to said motor, and said output means having an output advance speed corresponding to the frequency of the pulses of said pulsed drive signal, said output means advancing said date indicator means one date in response to a plurality of pulses of said drive signal;

first circuit means coupled to said motor for generating said pulsed drive signal, said pulsed drive signal having a fixed number of pulses each month to advance said date indicator during each month to said first position at the first day of the next month, said first circuit means including second circuit means for applying to said motor a first predetermined number of said pulses corresponding to the number of dates in each month at a normal advance frequency normally to advance said date indicator, and said first circuit means further including third circuit means for applying to said motor the remaining number of said fixed number of pulses for each month having less than 31 days at a rapid advance frequency greater than said normal advance frequency, said remaining number corresponding to the number of dates of each month less than 31, rapidly to advance said date indicator to said first position.

2. Means as claimed in claim 1 in which said first circuit means include time base means for producing a pulsed time base signal, first frequency divider means coupled to said time base means for producing a pulsed rapid advance frequency signal, second frequency divider means coupled to said first frequency divider means for producing a pulsed normal advance frequency signal, and control means coupled to said first divider means and said second divider means for producing said pulsed drive signal at said rapid advance frequency in response to said rapid advance frequency signal and at said normal advance frequency in response to said normal advance frequency signal.

3. Means as claimed in claim 2 in which said third circuit means include first switch means coupled between said first frequency divider means and said control means for switchably applying said pulsed rapid advance frequency signal to said control means, and further including gear means coupling said motor to said date indicator for advancing said date indicator means in response to said advancement of said output means, said gear means including actuator means coupled to said first switch means for actuating said first switch means.

4. Means as claimed in claim 3 in which said first switch means include a first and a second switch adjacent said actuator means, and in which said first actuator means include cam means for actuating said first and second switches to indicate the number of dates of each month, said cam means being advanced one revolution per year by said motor through said gear means and said cam means containing information relating to the number of dates of each month.

5. Means as claimed in claim 4 in which said cam means include a wheel rigid with said cam means having twelve teeth arranged substantially equally spaced around its circumference, and in which said actuator means include first protrusion means fixed with said date indicator and engaging with one tooth of said wheel each month for advancing said cam means one step each month for each month of the year to revolve the cam means once per year.

6. Means as claimed in claim 2 in which said first switch means include a third switch adjacent said actuator means and in which said actuator means include second protrusion means fixed with said date indicator means and adjacent said third switch for actuating said third switch during the change from the 28th to the 29th date of each month, and third protrusion means fixed with said date indicator means and adjacent said third switch for actuating said third switch during the change from the 30th to 31st date of each month.

7. Means as claimed in claim 3 in which said third circuit means include first counter means coupled to said switch means for counting the number of pulses of said pulsed rapid advance frequency signal applied to said control means, including disable means for removing said pulsed rapid advance frequency signal from said control means when the count of said pulses of said pulsed rapid advance frequency signal applied to said control means equals said remaining number of pulses.

8. Means as claimed in claim 1 further including gear means coupled between said output means and said date indicator means for advancing said date indicator means in response to the advance of said output means; hour indicator means coupled to said gear means for displaying the hour of a day in response to the advance of the output means; minute indicator means coupled to the gear means for displaying the minute of an hour in response to the advance of the output means; and second switch means coupled to said gear means for producing signals at predetermined dates of a month, said second switch means including third switch means for producing a first signal at the end of months having thirty dates and fourth switch means for producing a second signal at the end of the month of February; and in which said first circuit means include time base means for producing a pulsed time base signal, first frequency divider means coupled to said time base means for producing a pulsed rapid advance frequency signal from said time base signal, second frequency divider means coupled to said first frequency divider means for producing a pulsed normal advance frequency signal from said pulsed rapid advance frequency signal, control means coupled to said first divider means and said second divider means for producing said pulsed drive signal at said rapid advance frequency in response to said pulsed rapid advance frequency signal and at said normal advance frequency in response to said pulsed normal advance frequency signal; and in which said third circuit means include first logic means coupled to said third switch means and coupled between said first divider means and said control means for applying to said control means a second predetermined number, corresponding to said remaining number of said fixed number of pulses for months having thirty dates, of pulses of said pulsed rapid advance frequency signal in response to said first signal rapidly to advance said date indicator means to the first date of the next month; and second logic means coupled to said fourth switch means and coupled between said first divider means and said control means for applying to said control means a third predetermined number, corresponding to said remaining number of said fixed number of pulses for the month of February, of pulses of said pulsed rapid advance frequency signal in response to said second signal rapidly to advance said date indicator means to the first date of the next month.

9. Means as claimed in claim 8 in which said gear means include first actuator means coupled to said third switch means for producing a first selecting signal during each month having thirty dates, second actuator means coupled to said fourth switch means for producing a second selecting signal during the month of February, third actuator means coupled to said third switch means for producing a third selecting signal at the end of each month having thirty dates, fourth actuator means coupled to said fourth switch means for producing a fourth selecting signal at the end of the month of February.

10. Means as claimed in claim 9 in which said third switch means include third logic means for producing said first signal in response to said first selecting signal and said third selecting signal, and in which said fourth switch means include fourth logic means for producing said second signal in response to said second selecting signal and said fourth selecting signal.

11. Means as claimed in claim 10 in which said first logic means further include second counter means coupled between said first frequency divider means and said control means for applying said pulsed rapid advance frequency signal to said control means in response to said first signal and said first selecting signal.

12. Means as claimed in claim 10 in which said second logic means include second counter means coupled between said first frequency divider means and said control means for applying said pulsed rapid advance frequency signal to said control means in response to said second signal and said second selecting signal.

13. Means as claimed in claim 11 in which said second counter means include third counter means for counting the number of said pulses of said pulsed rapid advance frequency signal applied to said control means, including interrupt means for removing said pulsed rapid advance frequency signal from said control means when the count of said pulses of said pulsed rapid advance frequency signal applied to said control means equals said remaining number.

14. Means as claimed in claim 9 in which said gear means include cam means revolved once per year by said gear means, and said cam means include said first actuator means for producing said first selecting signal and said second actuator means for producing said second selecting signal.

15. Means as claimed in claim 14 in which said cam means include a wheel fixed with said cam means, said wheel having twelve teeth arranged substantially equally spaced around its circumference, and said wheel being located adjacent said date indicator means, and in which said gear means include protrusion means fixed with said date indicator means and engaging with one tooth of said wheel each month for advancing said cam means one step each month for each month of the year to revolve the cam means once per year.

16. Means as claimed in claim 8 in which said first circuit means include inhibitor means coupled between said first frequency divider means and said control means and coupled to said second frequency divider means for inhibiting the application of the pulsed rapid advance frequency signal to the control means during each pulse of the pulsed normal advance frequency signal applied to the control means.

* * * * *